US005143128A

United States Patent [19]

Chen

[11] Patent Number: 5,143,128

[45] Date of Patent: Sep. 1, 1992

[54] TABLE-TOP PLANER

[75] Inventor: Chin-Te Chen, Taichung, Taiwan

[73] Assignee: Shin Luen Facturing Factory Co., Ltd., Taichung, Taiwan

[21] Appl. No.: 664,856

[22] Filed: Mar. 5, 1991

[51] Int. Cl.[5] ..... B27G 19/00; B27C 1/00

[52] U.S. Cl. ..... 144/117 R; 144/114 R; 144/129; 144/130; 144/252 R; 144/253 G

[58] Field of Search ..... 144/144 R, 117 R, 129, 144/130, 253 R, 253 G, 252 R

[56] References Cited

U.S. PATENT DOCUMENTS

| | | | |
|---|---|---|---|
| 1,802,096 | 4/1931 | Tautz | 144/117 R |
| 2,642,902 | 6/1953 | Carey | 144/117 R |
| 3,171,454 | 3/1965 | Boice | 144/130 |
| 4,932,449 | 6/1990 | Omoto | 144/117 R |

*Primary Examiner*—W. Donald Bray
*Attorney, Agent, or Firm*—Bacon & Thomas

[57] ABSTRACT

A table-top planer, comprising a hollow base frame having two opposed bevel surface portions at the top with the first of which provided for mounting a guide board seat and the second of which provided for guiding chips from the cut out of the base frame; a first guide board mounted on two opposite side boards raising from the second bevel surface portion at two opposite sides; a second guide board mounted on the guide board seat at the top and longitudinally aligned with the first guide board; a plane iron transversely set between the first and second guide boards. Vent holes are formed on the second bevel surface portion through which induced outside air blows chips from the cut out of the base frame. Depth of cut is adjusted by changing the elevation of the guide board seat.

4 Claims, 5 Drawing Sheets

TABLE-TOP PLANER

BACKGROUND OF THE INVENTION

The present invention relates to planers, and more particularly relates to a table-top planer which is compact, lightweight and collapsible, and which utilizes outside air to expel chips from the cut.

In recent years, do-it-yourself (DIY) activities have has become popular in advanced countries. More particularly in North American and European countries, almost every family has a variety of tools and compact processing equipment prepared for DIY. For DIY, the tools and equipment must be compact and lightweight. There are a variety of small wood-working tools and devices developed for this purpose. FIG. 1 illustrates a known type of compact planer which has been claimed compact and lightweight and convenient for this purpose. However, it is still not satisfactory in use due to the following disadvantages.

1. It is a miniature of the known industrial model having a heavy base frame for mounting a motor therein;
2. It occupies much space for transport because the bench of which if not collapsible;
3. Depth of cut is inconvenient to adjust and difficult to precisely secure in position; and
4. Chips from the cut may be heaped up inside the machine to adversely affect the planing operation.

SUMMARY OF THE INVENTION

The present invention has been accomplished to eliminate the aforesaid disadvantages. It is therefore an object of the present invention to provide a table-top planer which is compact, lightweight and convenient for carrying and for operation on a table top.

It is another object of the present invention to provide a table-top planer which is collapsible to greatly reduce space occupation for transport.

It is still another object of the present invention to provide a table-top planer which has means for conveniently adjusting the depth of cut.

It is a yet further object of the present invention to provide a table-top planer which induces outside air to blow therethrough so as to expel chips from the cut.

DETAILED DESCRIPTION OF THE PREFERRED EMBODIMENT

Figure 1:
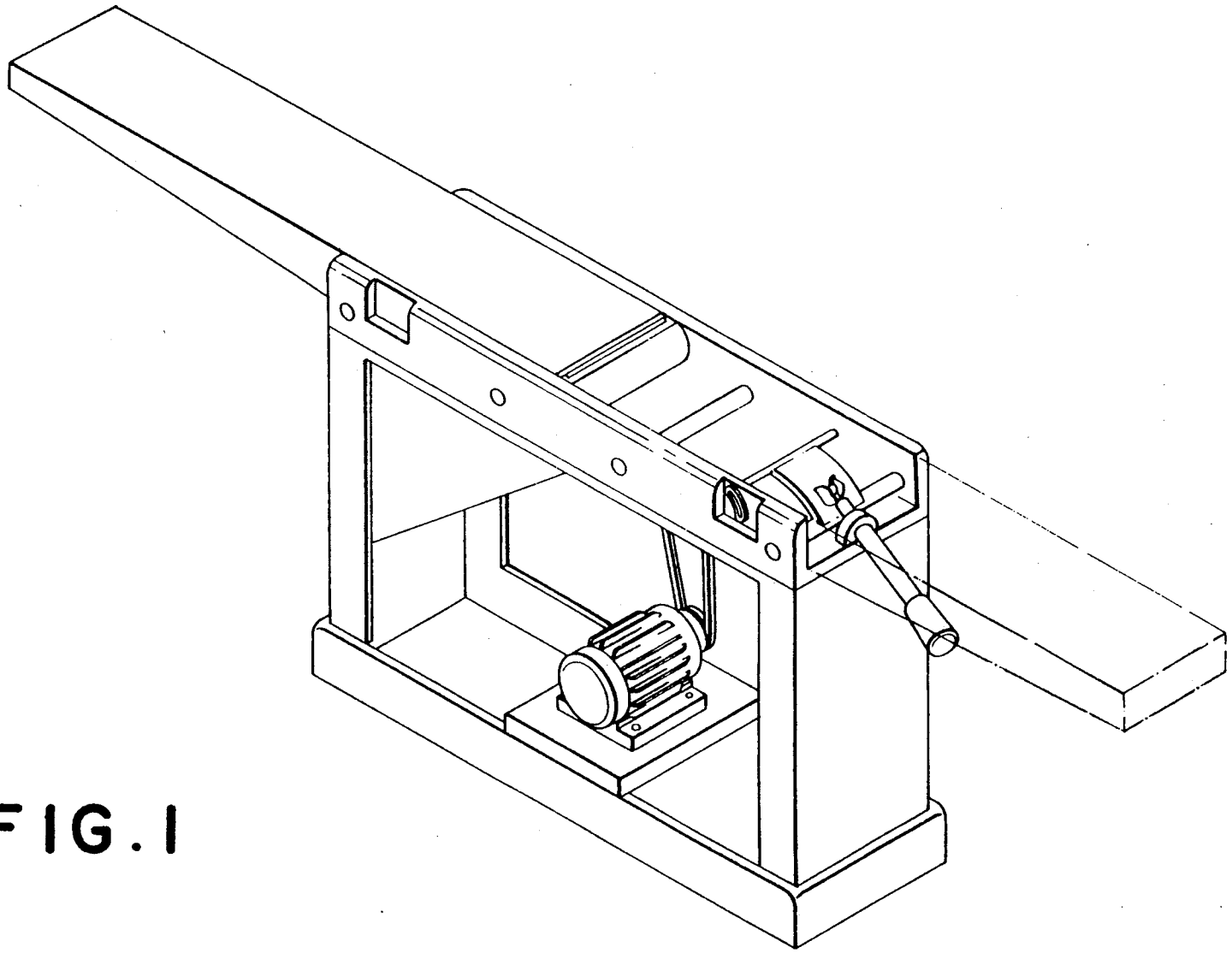
FIG. 1 is a perspective view of a compact type of planer according to the prior art.
Figure 2:
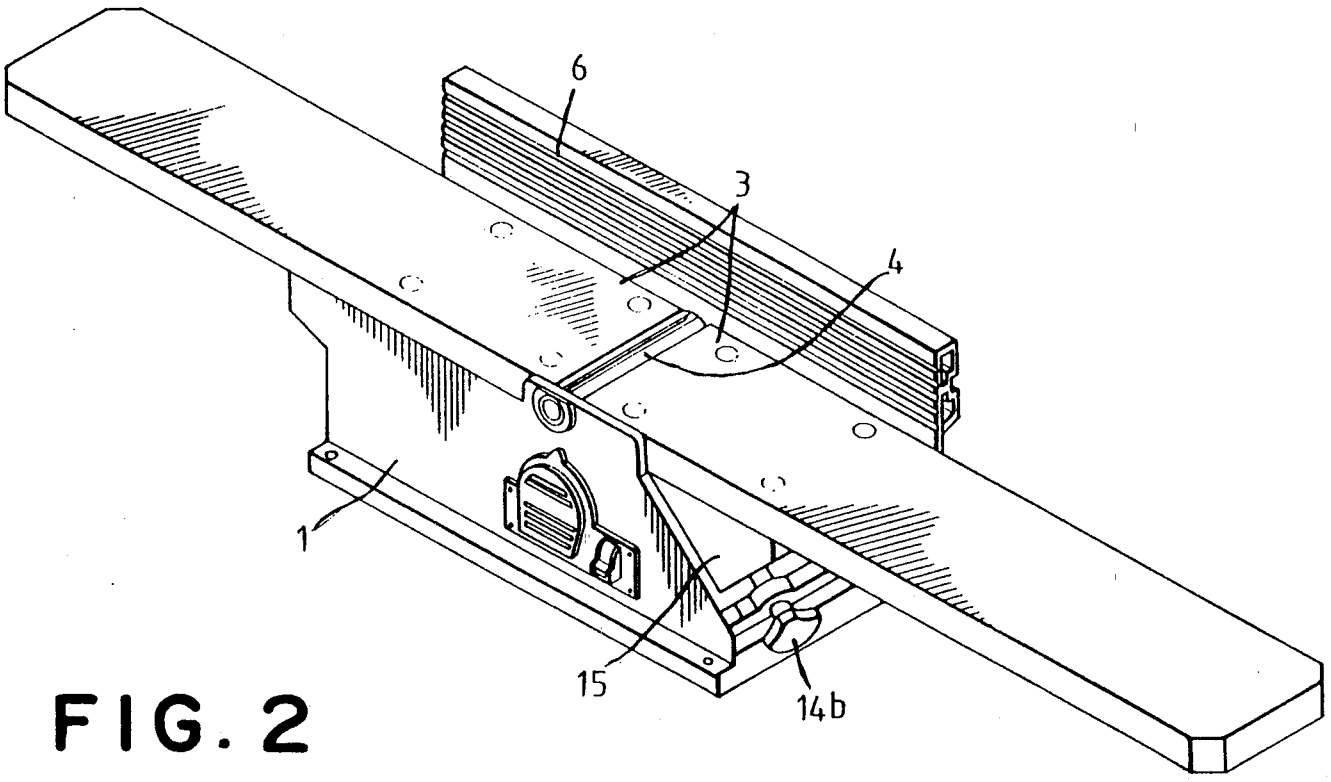
FIG. 2 is a perspective view of the preferred embodiment of the table-top planer of the present invention.
Figure 3:
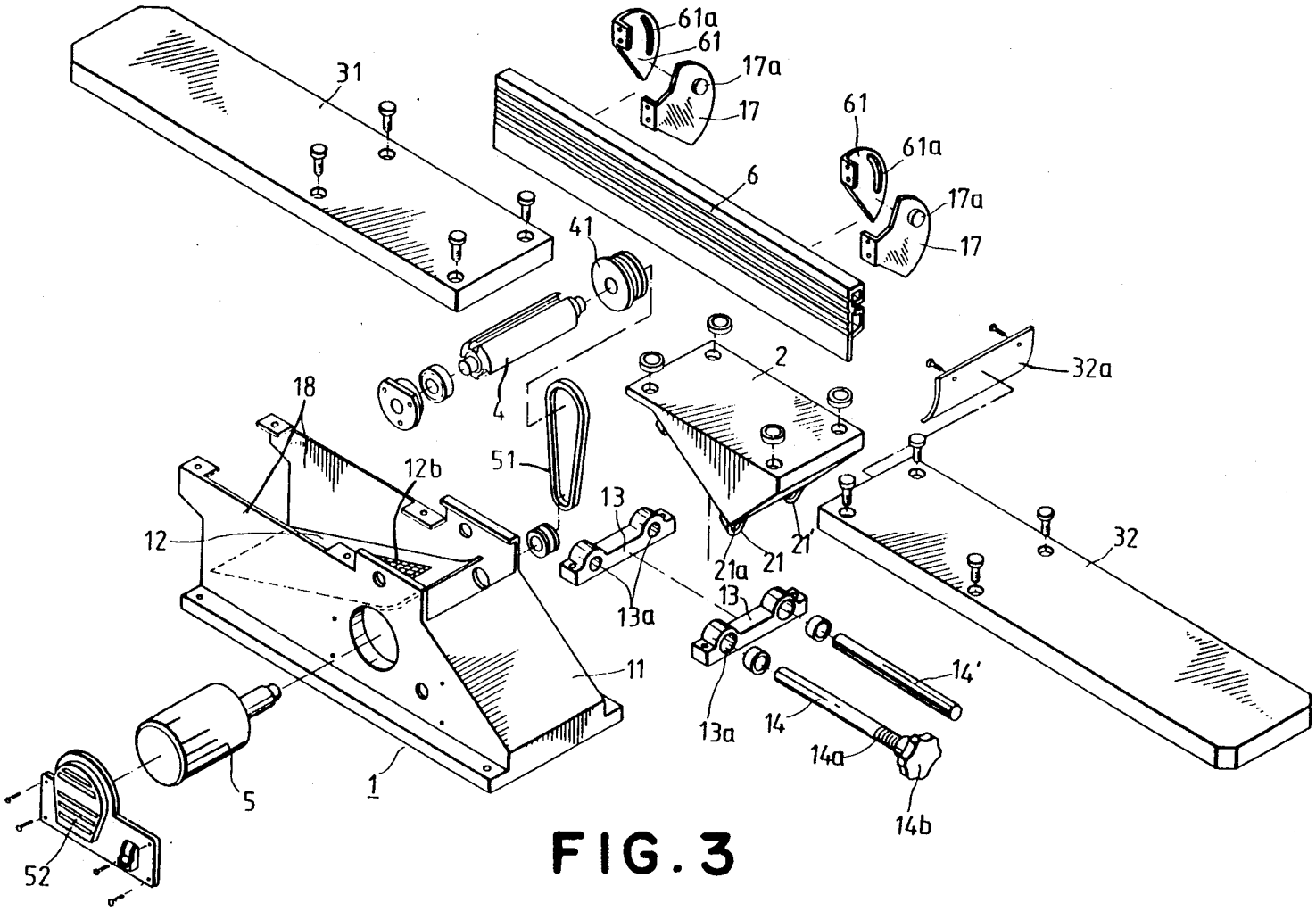
FIG. 3 is an exploded perspective dismantled view of the preferred embodiment of the present invention.

Referring to FIGS. 2 and 3, a table-top planer is shown in accordance with the present invention, which is generally comprised of a base frame 1, a seat 2, and a guide board assembly 3. The base frame 1 is comprised of a hollow, triangular body having a slope 11 and a slide way 12 opposed at the top. Two bolt holders 13 are respectively attached to the slope 11 of the base frame 1 at two opposite ends, each having each two guide holes 13*a* at two opposite ends for fastening two guide rods 14 and 14', wherein the guide rod 14 has an outer thread 14*a* and a knob 14*b* at one end.

The seat 2 has a bevel bottom edge fitting the slope 11 and comprises a plurality of eyed members 21 and 21' at the bottom corresponding to the bolt holders 13 of the slope 11 for fastening the guide rods 14 and 14', wherein the eyed member 21 has an inner thread 21*a*. By means of the guide rods 14 and 14', the seat 2 is allowed to slide on the slope 11. By means of fastening the outer thread 14*a* of the guide rod 14 with the inner thread 21*a* of the eyed member 21 the seat 2 is fixedly secured to the guide rod 14. Through the control of the knob 14*b*, the seat 2 can be adjusted to a higher or lower position to further adjust the difference of elevation between the top edge of the guide board 32, which is disposed at the top of the seat, 2 and the plane iron 4 according to desired depth of cut (see FIGS. 4 and 5).

In the foregoing statement, the position of the seat 2 is controlled by means of the effect of the slope 11 and the threads 14*a* and 21*a* of the guide rod 14 and the eyed member 21. This arrangement ensures precise adjustment at slow step with less labor consumption.

The guide board assembly 3 is provided for holding the working piece to be planed and is comprised of two opposed guide boards 31 and 32, wherein the first guide board 31 is fixedly secured to the base frame 1 at one end and disposed above the slide way 12, the second guide board 32 is mounted on the top of the seat 2 and longitudinally aligned with the first guide board 31. After setting, the working piece can be moved to slide on the first and second guide boards 31 and 32 during cutting. The guide boards 31 and 32 and the base frame 1 are approximately equal in length. They can be detached and packed together to minimize space occupation during transport.

The plane iron 4 is transversely mounted on the base frame 1 at the top center thereof for cutting. Inside the base frame 1, there is provided a motor 5 to drive the plane iron 4 for rotation via a driving belt 51 which is mounted between the output shaft of said motor 5 and a belt pulley 41 which is coupled with the plane iron 4 at one end.

Figure 4:
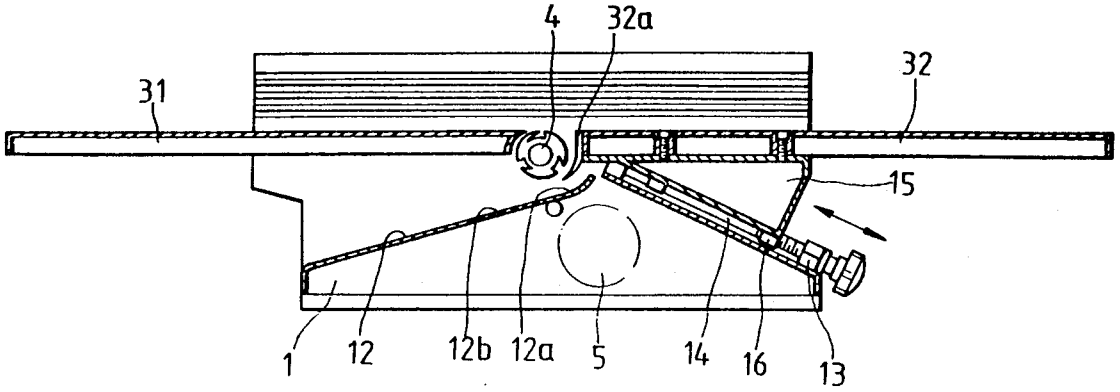
FIG. 4 is a longitudinally sectional view of the preferred embodiment of the present invention.
Figure 5:
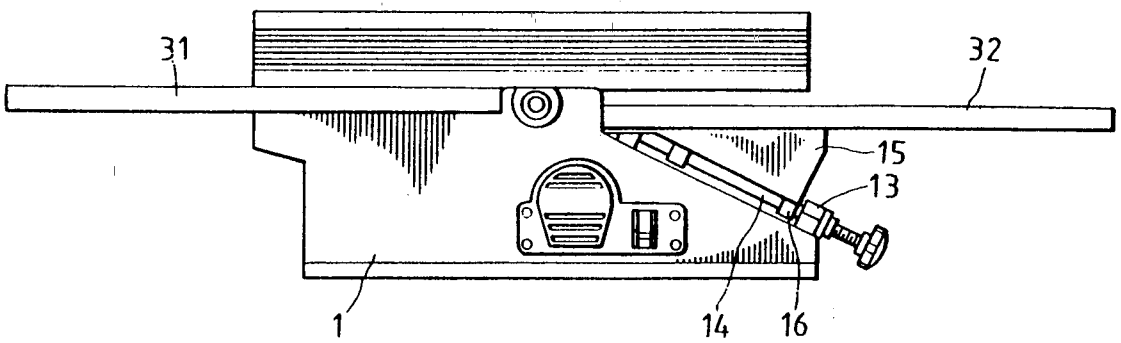
FIG. 5 is a front elevational view of the preferred embodiment of the present invention.

Referring to FIG. 4, the slide way 12 has an end 12*a* curvilinearly extending upwardly over the lower part of the plane iron 4. The guide board 32 has a circular fender 32*a* attached thereto at one end and disposed between the plane iron 4 and the end 12*a* of the slide way 12. Therefore, chips from the cut can be guided out of the base frame 1 through the slide way 12.

Further, the base frame 1 has a plurality of small vent holes 12*b* on the the slide way 12 near the end 12*a*, an air intake hole 52 for inducing outside cooling air to cool down the motor 5, and two opposite side boards 18 vertically disposed at the two opposite sides of the slide way 12. Therefore, the slide way 12 is surrounded by the side boards 18 and the first guide board 31 which define an outlet hole at one end for output of chips from the cut. When the motor 5 starts to operate, air current from the air intake hole 52 is rapidly exhausted through the small vent holes 12*b* to blow out cumulative chips from the cut. Because of this chip expelling function, the inclination of the slide way 12 is not so critical and therefore, the total height of the base frame 1 can be greatly reduced for table-top operation without affecting the performance of the present invention.

Figure 6:
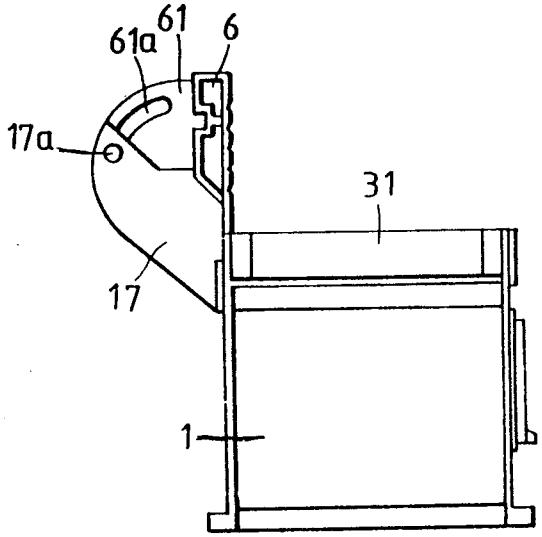
FIG. 6 is a side view of the preferred embodiment of the present invention.
Figure 7:
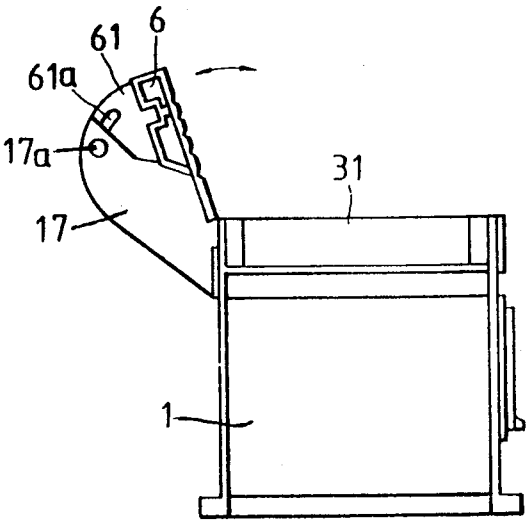
FIG. 7 is another side view of the present invention showing the manner of adjusting the fence.

Referring to FIGS. 6 and 7, there is a fence 6 pivotably connected to the base frame 1 at one side by a plurality sets of fastening means for stopping the working piece to be planed and adjusting the contact angle of the working piece to be planed with respect to the plane iron 4. The fastening means which is used to pivotably connect the fence 6 to the base frame 1 is comprised of a first sector plate 17 which is attached to the base frame 1 and has a screw knob 17*a* fastened therein at one side, and a second sector plate 61 which is attached to the fence 6 and has a curved slot 61*a* through which said screw knob 17*a* is fastened. By means of the control of the screw knob 17*a*, the first and second sector plates 61 can be relatively rotated and therefore, the angular position of the fence 6 relative to the guide boards 31 and 32 and the base frame 1 can be adjusted.

I claim:

1. A table-top planer comprising:

a) a hollow base frame having an air intake hole and a guide board seat adjustably secured to the frame at one end thereof;

b) a first guide board longitudinally mounted on said base frame and disposed in a horizontal position;

c) a second guide board longitudinally mounted on said guide board seat and disposed in a horizontal position corresponding to the position of said first guide board;

d) the base frame including a slope portion and a slide way portion, the guide board seat being mounted on the slope portion, and the slide way portion for guiding cut chips out of said base frame;

e) the slope portion including a pair of opposed bolt holders transversely secured at opposite ends thereof for fastening at least a guide rod and at least an adjusting screw rod to secure said guide board seat thereto, said adjusting screw rod having an outer thread portion fastened with an inner thread portion formed on said guide board seat at a bottom thereof for controlling the elevation of said guide board seat on said slope portion through a revolving control; and f) a plane iron transversely mounted on said base frame between said first and second guide boards, said slide way portion having a curved end disposed below the plane iron and a plurality of vent holes for communicating with the air intake hole of said base frame for permitting induced outside air to rapidly blow therethrough and expel cut chips from the slide way portion.

2. The table-top planer of claim 1 wherein the second guide board includes a circular fender attached thereto at one end thereof and disposed between said plane iron and said curved end of said slide way portion for guiding cut chips toward said slide way portion.

3. The table-top planer of claim 1 wherein said base frame further includes two opposite side boards extending upwardly from said slide way portion at opposite sides of the slide way portion, the first guide board being mounted on the side boards, the slide way portion being surrounded by said side boards and said first guide board to define an outlet hole opposite to said curved end for discharging cut chips.

4. The table-top planer of claim 1 wherein the first and second guide boards are longitudinally aligned and define a top surface on which a workpiece to be planed may be slidably moved therealong for cutting.

* * * * *